US012338735B2

(12) United States Patent
Hovda et al.

(10) Patent No.: US 12,338,735 B2
(45) Date of Patent: Jun. 24, 2025

(54) METHOD AND APPARATUS FOR CREATION OF AN OPEN HOLE SIDETRACK

(71) Applicant: CONOCOPHILLIPS COMPANY, Houston, TX (US)

(72) Inventors: Lars Hovda, Tananger (NO); Ole Jensen, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 18/434,998

(22) Filed: Feb. 7, 2024

(65) Prior Publication Data

US 2024/0263520 A1 Aug. 8, 2024

Related U.S. Application Data

(60) Provisional application No. 63/483,558, filed on Feb. 7, 2023.

(51) Int. Cl.
*E21B 7/06* (2006.01)
*E21B 7/04* (2006.01)

(52) U.S. Cl.
CPC ..... *E21B 7/061* (2013.01); *E21B 7/04* (2013.01)

(58) Field of Classification Search
CPC ..... E21B 7/061; E21B 7/04
See application file for complete search history.

(56) References Cited

U.S. PATENT DOCUMENTS 2,265,982 A * 12/1941 Bolton ..... E21B 7/065 175/4.58
2,324,102 A * 7/1943 Miller ..... E21B 7/065 175/231
2,350,986 A * 6/1944 Collins ..... E21B 7/064 175/417
2,903,239 A * 9/1959 Standridge ..... E21B 7/065 175/231
3,407,887 A * 10/1968 Vivion ..... E21B 4/02 175/106
4,194,566 A * 3/1980 Maly ..... E21B 43/26 166/308.1
5,462,118 A * 10/1995 Jennings, Jr. ..... E21B 37/00 166/50
2001/0040054 A1 11/2001 Haugen et al.
(Continued)

FOREIGN PATENT DOCUMENTS

RU 2579042 3/2016
RU 2709262 12/2019

OTHER PUBLICATIONS

International Search Report for PCT/US2024/014789 mailed May 22, 2024; 3 pgs.

*Primary Examiner* — Robert E Fuller
*Assistant Examiner* — Neel Girish Patel
(74) *Attorney, Agent, or Firm* — CONOCOPHILLIPS COMPANY

(57) ABSTRACT

Drilling a sidetrack in an open hole bore in a hydrocarbon reservoir of acid-soluble formation, e.g. carbonate formation, the creation of a sidetrack (11) in an open hole bore (10 for production of hydrocarbons from a carbonate rock formation (2). Acid is delivered to the location (6) where a sidetrack is to be created; the acid dissolves away the formation and creates a trench (7) from which the sidetrack (11) may be drilled.

12 Claims, 2 Drawing Sheets

(56) References Cited

U.S. PATENT DOCUMENTS

| | | | | |
|---|---|---|---|---|
| 2005/0150692 | A1 | 7/2005 | Ballantyne et al. | |
| 2008/0271925 | A1* | 11/2008 | Misselbrook | E21B 7/065 175/61 |
| 2008/0277166 | A1 | 11/2008 | Orban et al. | |
| 2009/0078419 | A1* | 3/2009 | Dusterhoft | C09K 8/50 166/295 |
| 2009/0288833 | A1 | 11/2009 | Graham et al. | |
| 2013/0264120 | A1* | 10/2013 | Zhou | E21B 7/046 175/73 |
| 2016/0024370 | A1* | 1/2016 | Ba geri | E21B 21/003 166/305.1 |
| 2016/0215605 | A1* | 7/2016 | Fontenot | E21B 43/14 |
| 2017/0107808 | A1 | 4/2017 | Forstner et al. | |
| 2019/0120035 | A1* | 4/2019 | Livescu | E21B 41/0078 |
| 2022/0356795 | A1* | 11/2022 | AlKhaldi | C09K 8/72 |
| 2024/0191576 | A1* | 6/2024 | Bataweel | E21B 7/002 |
| 2024/0241999 | A1* | 7/2024 | Han | G06F 30/13 |

* cited by examiner

METHOD AND APPARATUS FOR CREATION OF AN OPEN HOLE SIDETRACK

CROSS-REFERENCE TO RELATED APPLICATIONS

This application is a non-provisional application which claims benefit under 35 USC § 119(e) to U.S. Provisional Application Ser. No. 63/483,558 filed Feb. 7, 2023 entitled "METHOD AND APPARATUS FOR CREATION OF AN OPEN HOLE SIDETRACK," which is incorporated herein in its entirety.

FIELD OF THE INVENTION

This invention relates to the drilling of wells for the purpose of extracting hydrocarbons.

BACKGROUND OF THE INVENTION

When drilling wells for the extraction of hydrocarbons, it is sometimes desirable to drill a new bore or well from an existing bore or well. That is to say, to direct a drill bit into a side wall of an existing bore or well to create a branched bore, sometimes known as a sidetrack. When the existing well is a cased well, this is normally achieved by running into and anchoring in the well a whipstock—a device that provides an angled plane to direct the drill bit into the side wall of the well.

When the existing bore is uncased, i.e. open hole (OH), there is normally three options namely OH sidetrack, OH whipstock or cement based "kick off plug". The normal technique in an open hole is to rotate a drill bit in one place in the bore ("time drilling"); if the bore is angled or horizontal then this results in a portion of the lower wall of the bore being milled/ground away to make a hollow or trench on the lower side. If the drill bit can be kept in exactly the same place, the hollow or trench will have a relatively well defined shoulder or ledge at the distal end of the drill bit. As the hollow/trench becomes deeper this can allow the drill bit to start advancing into the shoulder/ledge to make a sidetrack.

The technique is time-consuming and not always effective. There is therefore a need for a faster and/or more reliable method of creating a sidetrack from an open hole.

BRIEF SUMMARY OF THE DISCLOSURE

The invention more particularly includes a process for drilling a sidetrack in an open hole bore in a hydrocarbon reservoir of acid-soluble formation, e.g. carbonate formation, wherein the process comprises:

a) advancing a drill bit on a drillstring through the open hole bore to a location at which a sidetrack is to be drilled;
b) Delivering acid through the drillstring to the location of the drill bit to dissolve away part of a side wall of the open hole bore and create a hollow in the side wall; and
c) Advancing the drill bit into the hollow to create a sidetrack.

The open hole bore may be non-vertical, e.g. inclined or substantially horizontal and the hollow may be created in a lower side wall of the open hole. The hollow may be created at a location where the direction of the open hole bore is turning upwards.

The drill bit may be rotated at the location where a sidetrack is to be drilled, without substantial movement of the drill bit along the bore, to erode the side wall of the open hole bore to help create the hollow prior to advancing the drill bit to create the sidetrack. The drill bit may be rotated in place after acid is delivered, whilst acid is being delivered or before acid is delivered, or any combination of these. Alternatively, the hollow may be created by delivery of acid to desired location without rotation of the drill bit in place.

After being advanced to the desired location, the drillstring may then be oscillated along the length of the open hole bore, the distal end of each oscillation being approximately at the said location. The oscillations may increase in length over time, e.g. with each successive oscillation. The oscillations are no longer than the length of a stand of drill pipe, e.g. 90 feet (27.4 m).

Between 1,000 and 11,500 litres of acid may be delivered, optionally between 3,000 and 7,000 litres of acid or optionally 1,000 litres, 2,000 litres, 3,000 litres, 4,000 litres, 5,000 litres, 6,000 litres, 7,000 litres, 8,000 litres, 9,000 litres, 10,000 litres, 11,000 litres, and 12,000 litres+/−10% or 100-1000 litres. The acid may be hydrochloric acid of concentration between 5% weight/volume (w/v) and 35% w/v, optionally between 15% and 25% w/v, such as about 10% w/v, 15% w/v, 20% w/v, 25% w/v, 30% w/v, or 35% w/v. A variety of HCl concentrations are commercially available from 1% to 37%, including about 1 M to 12 M, or 1 N to 12 N or approximately 3.65 g/l to 36.5 g/l (mass/volume). The acid may be delivered through an aperture in the distal end of the drill bit or through alternative or additional apertures in the bottom hole assembly.

The hollow created in step (b) may be between 50 feet and 800 feet long (between 15.2 m and 244 m long), optionally between 100 feet and 600 feet long (between 30.5 m and 183 m long), optionally between 300 feet and 500 feet long (between 91.4 m and 152 m long) or an approximate distance of 50 ft, 100 ft, 150 ft, 200 ft, 250 ft, 300 ft, 350 ft, 400 ft, 450 ft, 500 ft, 550 ft, 600 ft, 650 ft, 700 ft, 750 ft, 800 ft, 15 m, 20 m, 25 m, 30 m, 35 m, 40 m, 45 m, 50 m, 55 m, 60 m, 65 m, 70 m, 75 m, 80 m, 85 m, 90 m, 95 m, 100 m, 105 m, 110 m, 115 m, 120 m, 125 m, 130 m, 135 m, 140 m, 145 m, 150 m, 155 m, 160 m, 165 m, 170 m, 175 m, 180 m, 190 m, 195 m, or 200 m+/−10%, 10 ft or 5 m.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

While preferred examples of the present inventive concept have been shown and described herein, it will be obvious to those skilled in the art that such examples are provided by way of example only. Numerous variations, changes, and substitutions will now occur to those skilled in the art without departing from the disclosure. It should be understood that various alternatives to the examples of the disclosure described herein can be employed in practicing the disclosure. It is intended that the following claims define the scope of the disclosure and that methods and structures within the scope of these claims and their equivalents be covered thereby.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
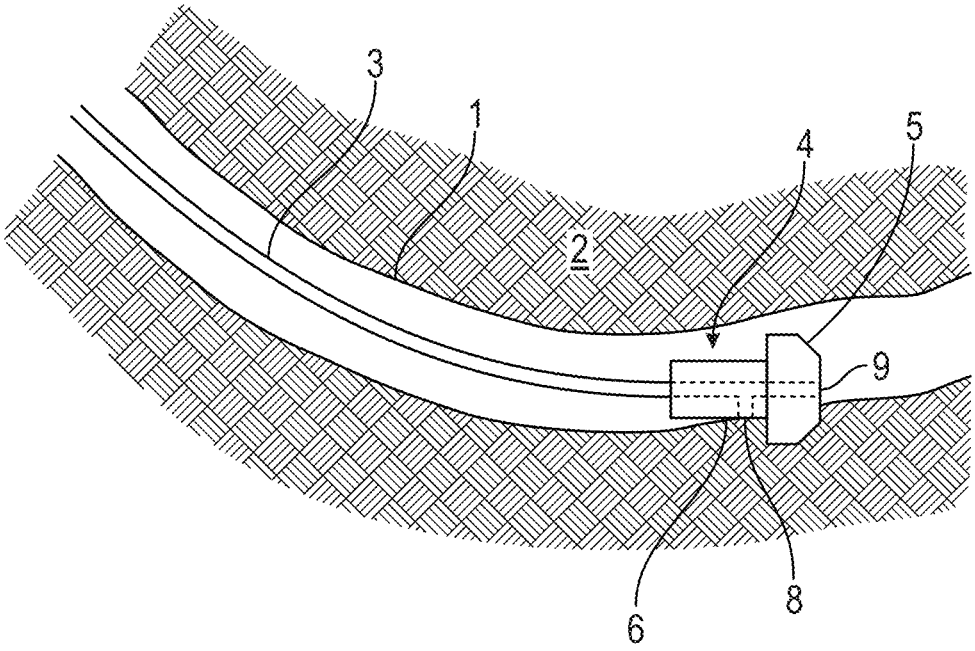
FIG. 1 is a schematic sectional view of an open hole wellbore and drillstring at the start of a procedure according to the invention.

As shown in FIG. 1, an open hole wellbore 1 extends through a carbonate rock formation 2. A drill string 3 extends through the open hole 1 from the surface, carrying a bottom hole assembly (BHA) 4 with a drill bit 5 at its distal end.

The wellbore 1 has been drilled but has produced no hydrocarbons after completion, so it has been decided to drill a sidetrack off the wellbore 1 to try to access a more productive zone. A location 6 in the wellbore 1 is selected for drilling the sidetrack. Although not essential, it is helpful for the location 6 to be just before the wellbore 1 makes an upward turn (sometimes referred to as a ramp).

The drill string is retracted to the desired location 6 (if it is still in the wellbore) or reintroduced and advanced to the location 6. Two processes may be then carried out that lead to formation of a hollow or trench 7 in a lower portion of the wellbore at the desired location 6. The processes are (1) the rotation of the drill bit whilst in the same location in the wellbore (or oscillating a short distance to and from the location), and (2) delivery of acid through the BHA. The two processes may be performed in either order or simultaneously. It may be possible to achieve the desired hollow/trench only by the use of acid to erode the lower wall of the wellbore but in practice it is more likely that both processes will be used.

In one example, so-called "time drilling" (rotation of the drill bit either without substantial movement along the wellbore or with an oscillating movement as described in more detail below) is carried out for a period of time to create a small hollow in the lower wall of the wellbore at the desired location 6. This is shown in FIG. 1, where the drill bit 4 can be seen to have partially penetrated the lower wall of the wellbore. Acid is then introduced through the drill string and out through an aperture 9 in the distal end of the drill bit and circulated back up the well bore to the surface. In a modification, acid may be dispensed through one or more additional apertures 8 in the BHA.

The time drilling may continue whilst the acid is being delivered and/or after delivery of the acid, e.g. whilst the acid is still reacting with the carbonate rock.

Figure 3:
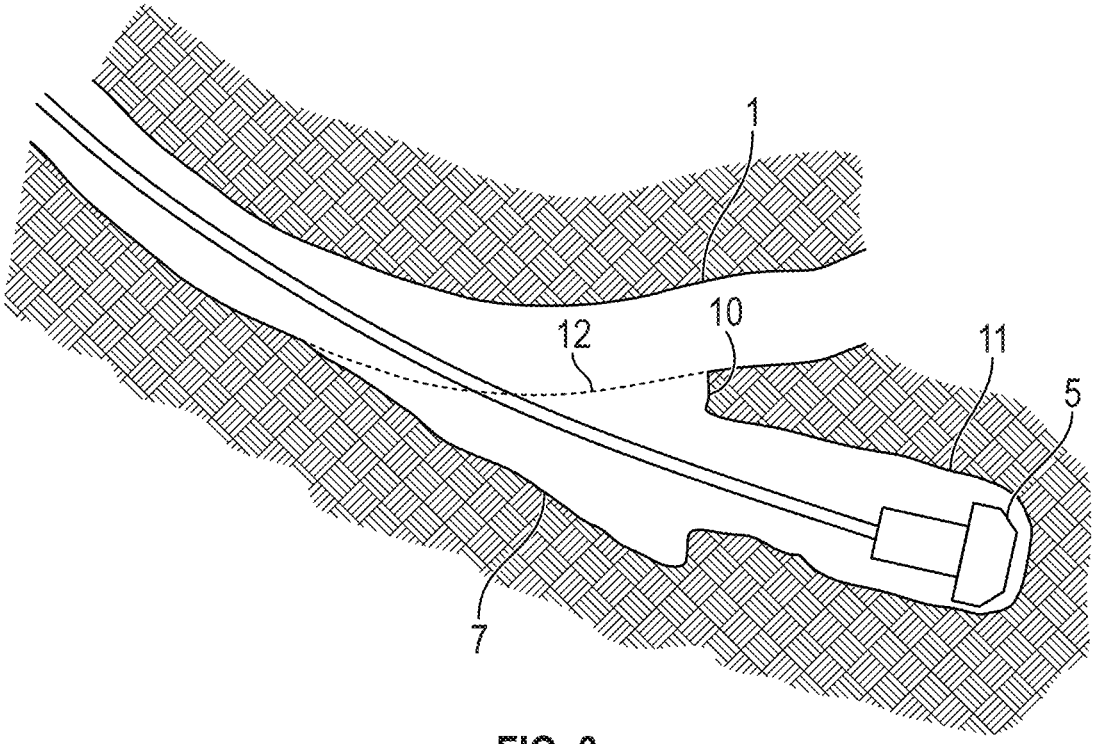
FIG. 3 a view similar to FIGS. 1 and 2 showing a sidetrack wellbore being drilled.

In this process it is desirable to achieve a well-defined shoulder or ledge 10 on the distal side of the hollow/trench 7. As the trench 7 deepens, the drill bit drops below the general level 12 of the lower wall of the wellbore 1, as shown in FIG. 3. The drill string may then be advanced, putting weight on the bit such that the drill bit 5 bears against the shoulder/ledge 10 and starts to create the bore of a new sidetrack 11.

Figure 2:
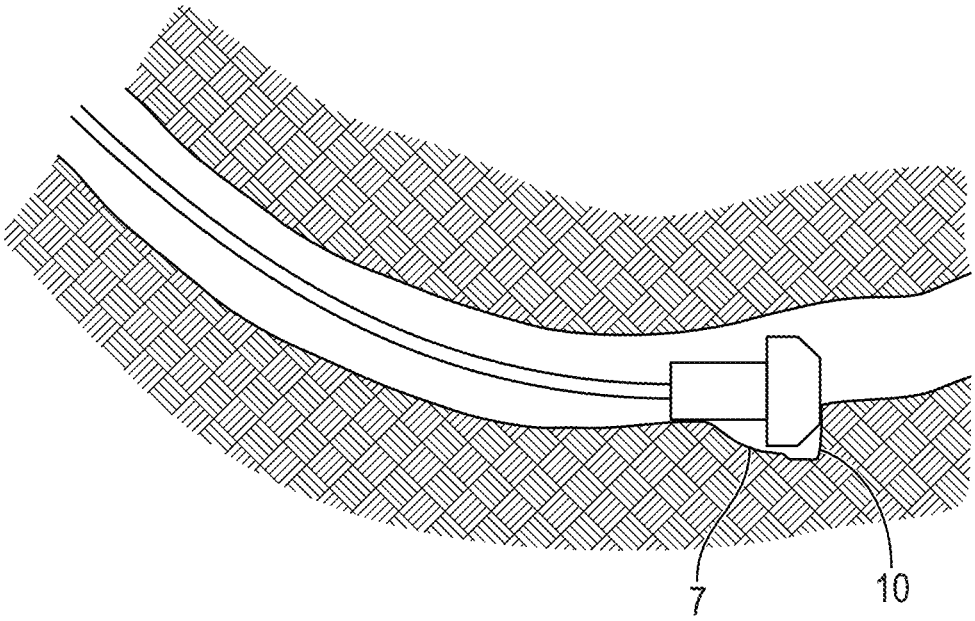
FIG. 2 a view similar to FIG. 1 showing an intermediate stage of the procedure according to the invention.

In practice the BHA, which may typically have a length of about 250 feet (76.2 metres), which rotates with the drill bit, will also erode the formation to some extent, creating an elongate trench 7 whose depth increases towards the distal end of the BHA, i.e. the drill bit (itself only about 18 inches or 46 cm long). This is desirable because the long BHA is relatively rigid and so, in order to drill a sidetrack, needs to be angled with respect the well bore. This can be seen in FIGS. 1 and 2.

Although the drill bit and BHA remain in essentially the same place in the well, in order to create a long angled trench 7, it may be preferable to oscillate or reciprocate the BHA back and forth along the well bore. The length of the oscillations or reciprocal movements may gradually increase over the time that the acid is delivered. For example, the BHA and drill bit may at the start extend to a location where the shoulder/ledge 10 of the trench 7 is to be created, and acid dispensed. Whilst acid is still being dispensed, the drill string may be withdrawn some 3 metres and then returned to the start location; then the drill string may be withdrawn by 6 metres and returned to the start location, then by 9 metres, and so on. In this way the distal end of the trench gets more exposure to fresh acid and the exposure of the trench to acid diminishes gradually further back (proximally) along the trench. Since more acid is delivered to the distal end of the trench than to the proximal end, and this helps to create a trench 7 with a relatively sharp ledge/shoulder 10 and a gradual slope leading to the ledge/shoulder 10. This technique relies on acid being dispensed only through a hole or holes 8, 9 in the drill bit and/or towards the distal end of the BHA. For practical reasons to do with the length of one stand of drill pipe, the maximum length of the oscillations may be 90 feet (27.4 m). However, a shallow trench may be created that extends proximally from the ledge/shoulder 10 by more than 90 feet (27.4 m). Preferably, it extends the length of the BHA or further, e.g. up to 400 feet (122 m).

It is preferable that the BHA is rotated during the reciprocating operation. It is believed this will induce movement in the acid and will help to bring fresh acid in contact with the lower side of the well bore. The wellbore is, of course, full of drilling fluid and this is denser than the acid so it is possible the acid may float to the upper side of the well bore and the rotation of the BHA may help prevent unnecessary exposure of the upper side of the wellbore to acid. The circulating acid may also tend to flow along the upper side of the BHA since the BHA will rest under gravity on the lower side of the well bore and there will be a lower resistance pathway for the returning acid along the upper side of the BHA.

The acid used may be standard 15-35% hydrochloric acid that is normally used in acid stimulation of a carbonate formation, although other strong acid may be used.

It is envisaged that in a 6.5 inch (16.5 cm) open hole, approximately 35 barrels (5,565 litres) of 35% HCl may be used to create the trench, dispensed into the open hole at a rate of approximately 40 gallons per minute (151 litres per minute). Many factors will affect the volume of acid needed, including the diameter of the bore (which may be larger, e.g. 8.5 inch (21.6 cm) or 9.5 inch (24.1 cm) and whether there are drill cuttings present in the bore, which will potentially react with the acid so that less acid is available to dissolve the formation.

The corrosive effect of the acid on the drill bit and BHA is still not fully understood and the inventors are currently investigating the best material from which to manufacture the drill bit and BHA. It may be that the standard grades of steel used in conventional drill bits and BHAs for use in carbonate formations in the North Sea will suffice. However, it is possible that more acid-resistant steel or alloys will be required.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for drilling a sidetrack in an open hole bore in a carbonate hydrocarbon reservoir, wherein said process comprises:

a) advancing a drill bit and an associated bottom hole assembly (BHA) on a drillstring through the open hole bore to a location at which the sidetrack is to be drilled;

b) delivering acid through the drillstring to the location of the drill bit to dissolve away part of a side wall of the open hole bore;

c) whilst delivering acid, oscillating the drillstring back and forth along the length of the open hole bore to create a hollow in the side wall, wherein the distal end of each back and forth oscillation is approximately at the said location and wherein the back and forth oscillations increase in length over time, whereby the hollow is created of at least the length of the BHA and having a shoulder or ledge and wherein the hollow is created prior to creating the sidetrack; and d) advancing the drill bit into the hollow to create the sidetrack.

2. The process according to claim 1, wherein the open hole bore is not vertical and wherein the hollow is created in a lower side wall of the open hole.

3. The process according to claim 2, wherein the hollow is created at a location where the direction of the open hole bore is turning upwards.

4. The process according to claim 1, wherein the drill bit and an associated bottom hole assembly (BHA) are rotated at the location where the sidetrack is to be drilled to erode the side wall of the open hole bore to help create the hollow prior to advancing the drill bit to create the sidetrack.

5. The process according to claim 4, wherein acid is delivered during the rotation of the drill bit at the location where the sidetrack is to be created.

6. The process according to claim 4, wherein acid is delivered before the rotation of the drill bit at the location where the sidetrack is to be created.

7. The process according to claim 4, wherein acid is delivered after the rotation of the drill bit at the location where the sidetrack is to be created.

8. The process according to claim 1, wherein the oscillations are no longer than the length of a stand of drill pipe or 90 feet (27.4 m).

9. The process according to claim 1, wherein an approximate amount of acid delivered is selected from between 1,000 and 11,500 litres.

10. The process according to claim 1, wherein the acid is hydrochloric acid of an approximate concentration selected from between 5% w/v and 35% weight/volume (w/v).

11. The process according to claim 1, wherein acid is delivered through an aperture in a distal end of the drill bit.

12. The process according to claim 1, wherein the hollow created in step (b) is selected from approximately between 50 feet and 800 feet long (between 15.2 m and 244 m long).

* * * * *